US007762531B2

(12) United States Patent
Bond

(10) Patent No.: US 7,762,531 B2
(45) Date of Patent: Jul. 27, 2010

(54) CALIBRATED MECHANICAL WINCH AND METHOD OF MANUFACTURE

(76) Inventor: Mark Bond, Route 2, Box 225, Marietta, OK (US) 73448

( * ) Notice: Subject to any disclaimer, the term of this patent is extended or adjusted under 35 U.S.C. 154(b) by 0 days.

(21) Appl. No.: 12/418,370

(22) Filed: Apr. 3, 2009

(65) Prior Publication Data

US 2009/0250543 A1 Oct. 8, 2009

Related U.S. Application Data

(60) Provisional application No. 61/123,124, filed on Apr. 3, 2008.

(51) Int. Cl.
*B21F 9/00* (2006.01)

(52) U.S. Cl. ..... 254/218; 254/223; 24/69 ST

(58) Field of Classification Search ..... 254/217, 254/218, 222, 223, 237–239; 24/69 ST, 71 ST
See application file for complete search history.

(56) References Cited

U.S. PATENT DOCUMENTS 3,722,267 A 3/1973 Gordon
3,762,777 A 10/1973 Jacob et al.
3,791,210 A 2/1974 Taylor
4,226,405 A 10/1980 Roodt
4,235,420 A * 11/1980 Ross et al. ..... 254/218
4,408,925 A 10/1983 Louie
4,542,883 A * 9/1985 Rutzki ..... 254/217
5,295,664 A * 3/1994 Kamper ..... 254/220
5,485,762 A 1/1996 Rothman
5,954,041 A 9/1999 Sands
6,007,053 A * 12/1999 Huang ..... 254/247
6,279,415 B1 8/2001 Chance et al.
6,908,073 B1 * 6/2005 Hsien ..... 254/218
6,973,852 B2 12/2005 Shin et al.
7,219,396 B2 * 5/2007 Hsieh ..... 24/68 R
7,350,768 B1 * 4/2008 Chang ..... 254/218
7,509,711 B2 * 3/2009 Hsieh ..... 24/68 CD
2006/0011380 A1 1/2006 Pierce
2006/0117901 A1 6/2006 Owyang
2007/0022675 A1 2/2007 Weisman

* cited by examiner

*Primary Examiner*—Emmanuel M Marcelo
(74) *Attorney, Agent, or Firm*—Winstead PC

(57) ABSTRACT

A ratchet-driven mechanical winch that is adapted to measure the force applied to a cable, wire, or other tether through the operation of Hooke's Law. The device operates by compressing a pair of linear springs as increasing force is applied to the cable, wire, or other tether.

21 Claims, 10 Drawing Sheets

CALIBRATED MECHANICAL WINCH AND METHOD OF MANUFACTURE

CROSS-REFERENCE TO RELATED APPLICATIONS

This application claims priority to, and incorporates by reference the entire disclosure of, U.S. Provisional Patent Application 61/123,124, filed Apr. 3, 2008, entitled CALIBRATED MECHANICAL WINCH AND METHOD OF MANUFACTURE.

BACKGROUND OF THE INVENTION

1. Field of the Invention

The present invention relates to a calibrated mechanical winch, and more particularly, but not by way of limitation, to a calibrated mechanical winch and method of manufacture thereof, the winch being adapted for stretching and tightening wire and/or other cables, tethers and the like by utilization of a manually operable device allowing for the user to ascertain the general level of tension applied to the cable or other tether being acted upon during the stretching operation.

2. History of the Related Art

Many devices have been used for tensioning cables, wires and other tethers over the decades. A common manual approach to tightening wire is seen in the area of fencing. Farm land generally spans many miles and requires a variety of fenced sections that may be manually installed with available equipment. For example, barbed wire is common in various states, such as Texas, and many varieties have been used by farmers, ranchers and the like. The manual stretching of barbed wire between two fence posts is a common practice, even today. Fortunately, the manual stretching of such wire is often facilitated by mechanical winches actuatable by the user. One such mechanical winch is conventionally known as a "come along." This device allows the user to grasp one end of a strand of fencing, such as a barbed wire strand, and apply a manual force thereto relative to a fixed object and/or another strand of wire. While handy to use, the use of come along type devices has certain disadvantages. One distinct disadvantage is the inability to readily ascertain, with much accuracy, the general level of tension being applied to the wire without some form of independent tension measuring device or method. For this reason, it is common to simply hit the tensioned wire with a metal object, such as a screwdriver or similar item, to ascertain the vibrational tone of the wire and audibly determine if appropriate tightness has been applied thereto. This approach, though common, does not provide precise information as to the tension such that it can be accurately repeated along multiple strands of a fenced section. Uniform tension among the multiple strands of a fenced section is, however, very important and therefore a device providing stretching and such information would prove useful.

The tensioning of wire strands is not the only application where cables, tethers and wires must be stretched. When erecting vertical structures, such as radio or television antenna towers, wire stays or the like are often used. Tensioning devices must be incorporated in such applications in order to avoid the potential risk of property damage and personal injury should the tensioning of the cable or the wire strand fall outside of the engineering specification. While the failure of a wire or cable support for a tower is generally much more catastrophic than the failure of a length of fencing wire, there are many considerations that are common between the two. For example, due to the thermal coefficient of expansion, the ambient air temperature has a direct bearing on the appropriate wire tension. Wires constructed of metallic materials inherently have a known thermal coefficient of expansion. The wire will thus expand and contract as the ambient temperature rises or falls. If, for example, wire is installed in the heat of the summer at a select tension, when the ambient temperature drops in the autumn and winter months, the metal in the wire will contract thereby increasing the load on the wire; possibly resulting in the wire breaking. For this reason, it would be important to observe the degree of tension, relative to the ambient temperature, placed upon a wire, cable, tether, or the like during the tensioning process.

Various approaches to measuring tensioning of wire and cable have been addressed over the years. For example, U.S. Pat. No. 3,791,210 to Taylor discloses a tension measuring device that measures cable tension as a function of deflection of its component members. U.S. Pat. No. 4,408,925 to Louie discloses a turnbuckle tensioner which applies tension to a cable through the deflection of a series of belleville washers. U.S. Pat. No. 5,485,762 to Rothman discloses a cable tensioner which uses a linear ratchet to apply tension to a cable. U.S. Pat. No. 6,279,415 to Chance, et al. discloses a cable tensioner that utilizes a linear spring to apply tension to a cable. However, none of these inventions contemplate a come-along style mechanical winch that is calibrated to provide a accurate measurement of cable tension while the wire or cable is being stretched by a user.

It would thus be an advantage to provide a manual winch capable of indicating the degree of tension being applied a wire or cable during a manual tensioning procedure. It would be a further advantage for such a device to be in a configuration that works in a fashion to similar come along devices that are commonly used and well known in the farming and ranching industry. The present invention provides such an improvement by utilizing a mechanical winch having a tension calibration feature incorporated therewith.

SUMMARY OF THE INVENTION

The present invention relates to a calibrated mechanical winch. In one aspect, the invention relates to a hand-held mechanical winch of the type operable for stretching wire and/or cables. The mechanical winch comprises a manually actuated spool disposed within a frame and connected thereto by a plurality of springs. A length of cable or wire is operably coupled to the spool, and a brake axle is located a fixed distance from the spool. Successive actuation of the spool support assembly applies incrementally increasing tension to the length of cable or wire and causes compression of the plurality of springs in an amount proportional to the tension applied to the length of cable or wire.

In another aspect, the invention relates to a method of manufacturing a calibrated mechanical winch. The method of manufacturing comprises forming a frame and locating a spool support assembly within the frame. The spool support assembly is then connected to the frame with a plurality of springs, and a length of cable or wire is connected to the spool support assembly. A handle is connected to the spool support assembly, wherein successive actuation of the handle applies incrementally increasing tension to the length of cable or wire and causes compression of the plurality of springs in an amount proportional to the tension applied to the length of cable or wire.

In another aspect, the invention relates to a method of tensioning a cable or wire. The method comprises providing a hand-held mechanical winch, connecting a first coupler to a fixed support, and connecting a second coupler to a length of cable or wire to be tensioned. Tension is then applied to the length of cable or wire which compresses a plurality of springs located in the hand-held mechanical winch. The tension applied to the length of cable or wire is then measured as a function of compression of the plurality of springs.

In another aspect, the invention relates to a calibrated mechanical winch having an adjustable limit switch for further assisting in ascertaining a pre-determined level of tension applied to a cable or wire. The limit switch is initially secured underneath a stop and is spring-biased to rotate when the stop is removed. The stop is able to move responsive to the compression of springs disposed in the frame of the mechanical winch. When enough tension is applied to the cable or wire to compress the springs a sufficient distance, the stop loses contact with the limit switch. The spring then induces the limit switch to rotate. Such motion alerts the user to when a desired level of tension has been reached.

BRIEF DESCRIPTION OF THE DRAWINGS

The accompanying drawings, which are incorporated in and constitute a part of this specification, illustrate several embodiments of the invention and, together with the description, serve to explain principles of the invention.

DETAILED DESCRIPTION

Figure 1A:
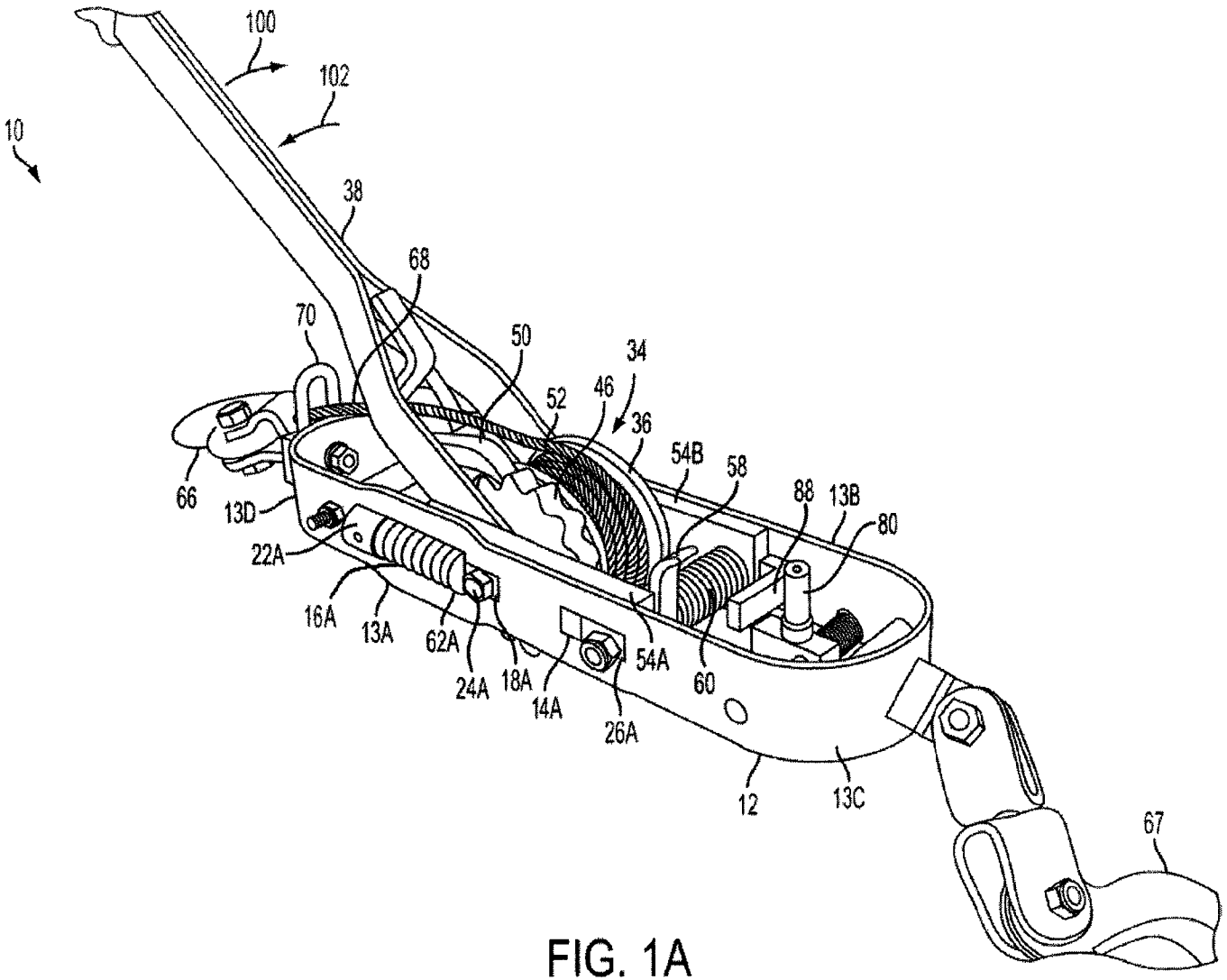
FIG. 1A is a perspective view of one embodiment of a mechanical winch constructed in accordance with the principles of the present invention.

Reference is now made in detail to exemplary embodiments of the present invention illustrated in the accompanying drawings. Wherever possible, the same reference numerals are used throughout the drawings to refer to the same or similar parts.

Figure 1B:
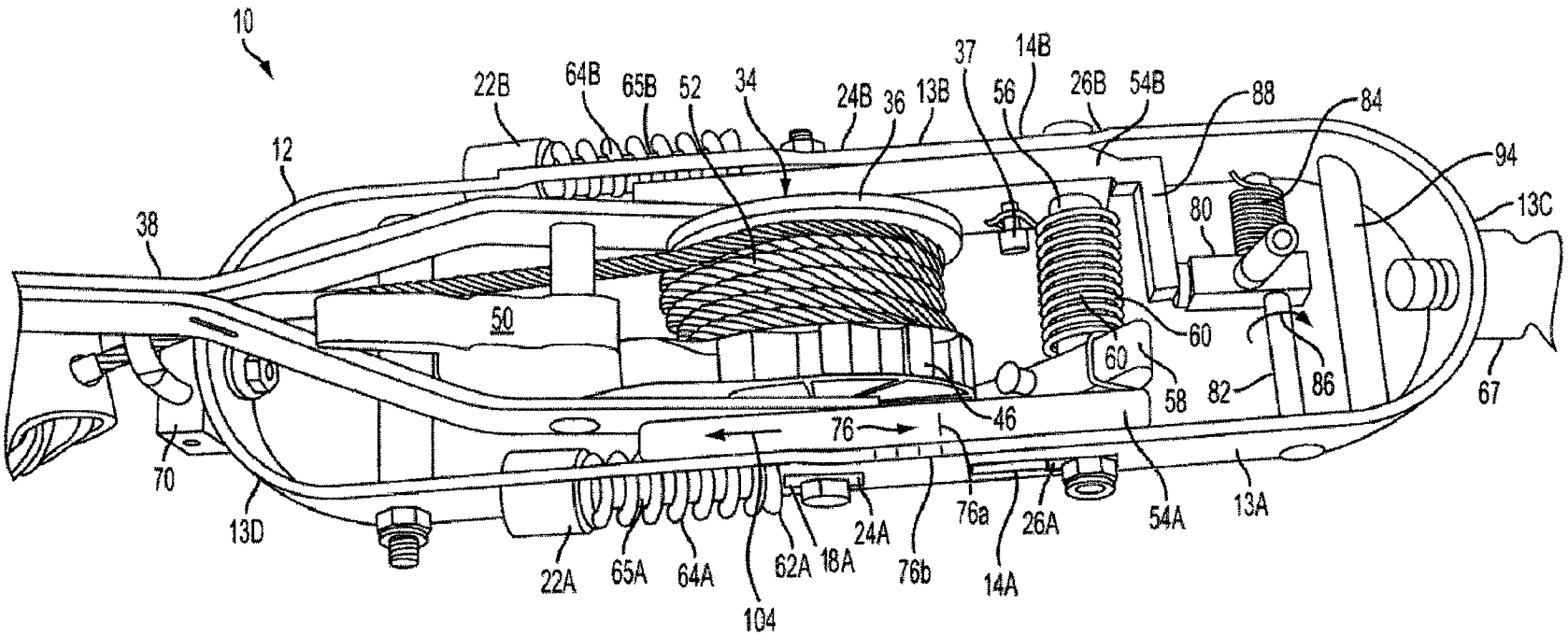
FIG. 1B is a top plan view of the mechanical winch of FIG. 1A.

As shown in FIGS. 1A and 1B, a mechanical winch 10 comprises an exterior frame 12. The exterior frame 12 may be constructed of any appropriate material. For example, a strip of ⅛ inch thick cold rolled steel that is approximately 1.5 inches wide and approximately 28⅜ inches long. The exterior frame 12 is formed by shaping the steel strip into a roughly ovoid shape having parallel sides 13A and 13B, and opposing rounded ends 13C and 13D. Alternatively, the exterior frame 12 may be formed by joining the parallel sides 13A and 13B to the rounded ends 13C and 13D through a process such as welding. Although, the exterior frame 12 is depicted by way of example as being roughly ovoid, the frame may be formed into any other appropriate shape, such as rectangular. A pair of slots 14A and 14B, both having the form of a rectangular slot, are disposed opposite each other on the parallel sides 13A and 13B, respectively. Slot 14B may be seen more clearly in FIG. 2 discussed below. Similarly, a pair of slots 16A and 16B (shown in FIG. 2), also having the form of a rectangular slot of slightly greater length and width than the slots 14A and 14B, are also disposed opposite each other on the parallel sides 13A and 13B respectively. A pair of notches 18A and 18B are cut into a side of slots 16A and 16B respectively on a side facing slots 14A and 14B respectively.

Figure 2:
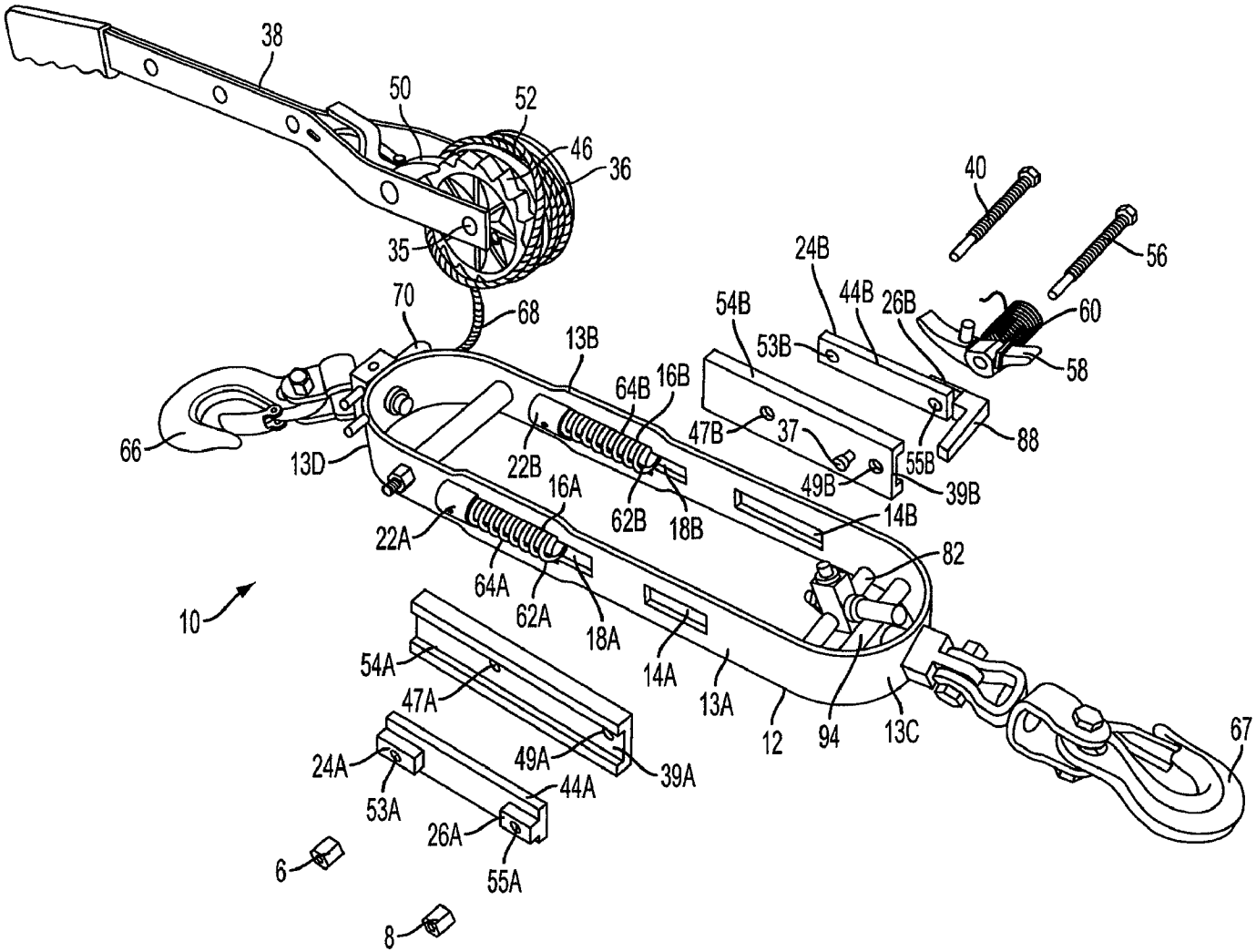
FIG. 2 is an exploded perspective view of the mechanical winch of FIGS. 1A-1D illustrating certain parts thereof.

Still referring to FIGS. 1A and 1B, a spool support assembly 34 includes a spool 36, a handle 38, a spool axle 40 (shown in FIG. 2), a brake axle 56, a pair of sliding plates 54A and 54B, and a pair of sliding supports 44A and 44B (shown in FIG. 2). The spool 36 includes a ratchet wheel 46 disposed on a side of a central hub 48 (not shown). In FIGS. 1A and 1B the spool 36 is shown by way of example to be disposed between opposite sides of the handle 38 and is rotatably secured thereto by the spool axle 40. However, the spool may be secured to the handle in any appropriate arrangement. Spool axle 40 also secures the spool support assembly 34 to the exterior frame 12. The handle 38 includes a drive pawl 50 disposed so as to engage the ratchet wheel 46 in such a way so as to impart motion to the spool 36 when handle 38 is rotated a direction denoted by arrow 100 shown in FIG. 1A. A cable 52 is secured to the spool 36 and wrapped therearound.

Referring now to FIGS. 1B and 2 in combination, the spool support assembly 34 is disposed within the exterior frame 12. A pair of T-nuts 24A and 24B are slidably disposed within the notches 18A and 18B. A pair of T-nuts 26A and 26B are slidably disposed within the slots 14A and 14B. A pair of spring stops 62A and 62B abut the T-nuts 24A and 24B, and are disposed within the slots 16A and 16B. A second pair of spring stops 22A and 22B are disposed in slots 16A and 16B respectively. A pair of springs 64A and 64B are disposed in the slots 16A and 16B between the spring stops 22A and 62A as well as 22B and 62B, respectively.

Figure 1C:
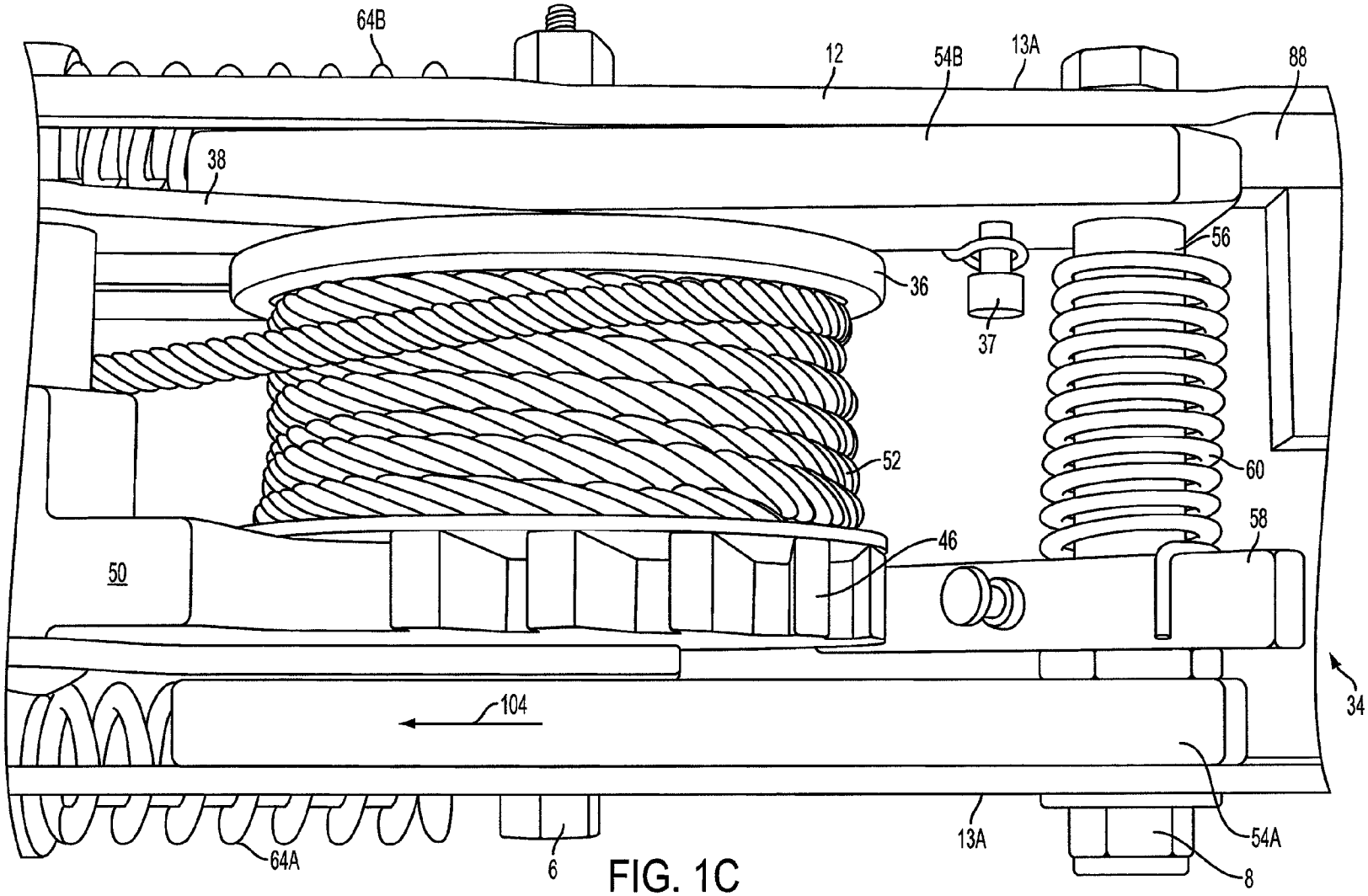
FIG. 1C is a top view of a spool support assembly of the mechanical winch of FIG. 1A.
Figure 5A:
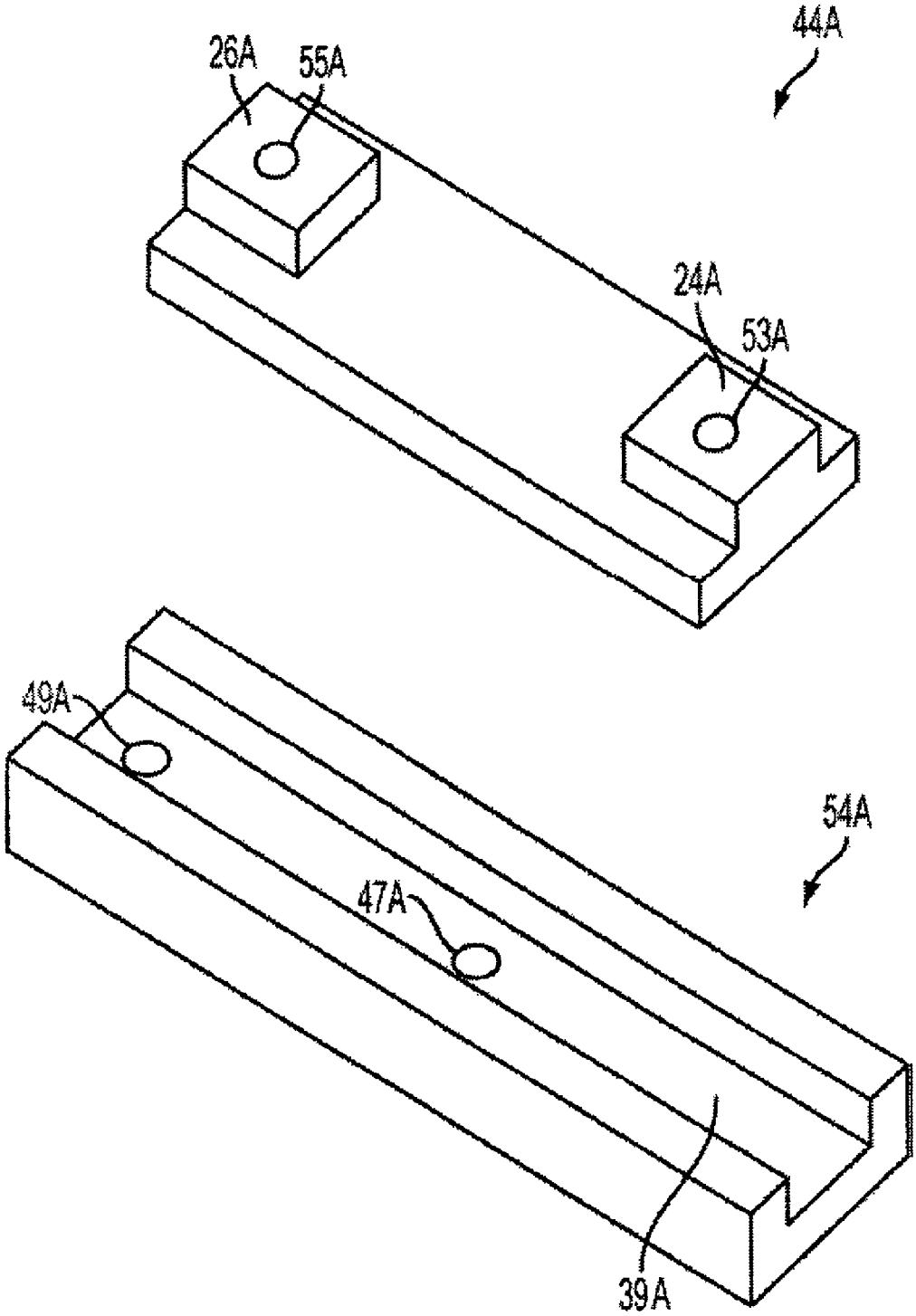
FIG. 5A is a perspective view of a first sliding support and a first sliding plate of the winch of FIGS. 1A-1D.
Figure 5B:
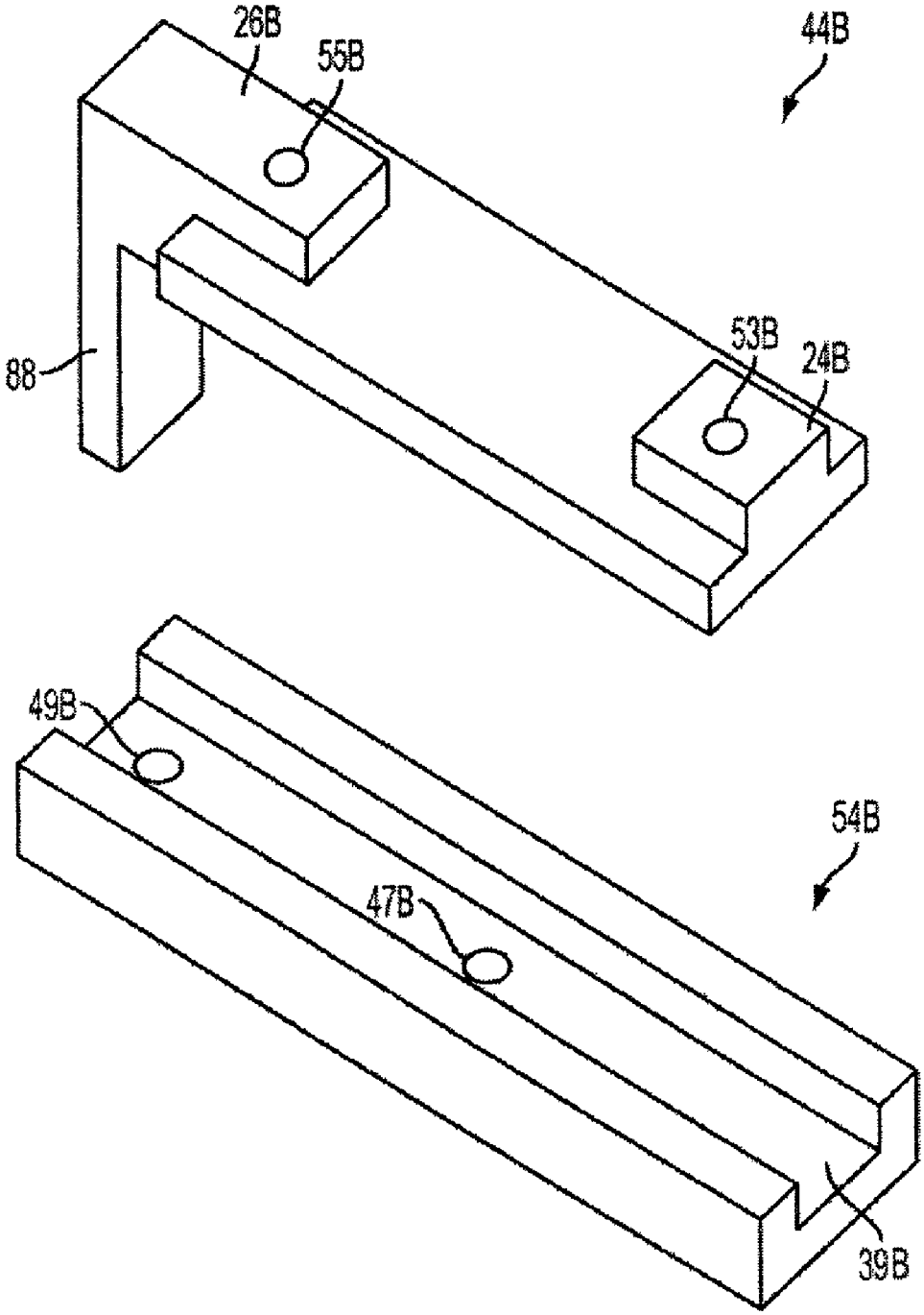
FIG. 5B is a perspective view of a second sliding support and a second sliding plate of the winch of FIGS. 1A-1D.

Referring now to FIG. 1C, the brake axle 56 is disposed between the sliding plates 54A and 54B at a position proximal to the spool axle 40 (shown in FIG. 2). Sliding plates 54A and 54B are formed to receive sliding supports 44A and 44B (shown in FIG. 2) and contain holes 47A and 47B, 49A and 49B that line up with holes 53A and 55A, and 53B and 55B formed in sliding supports 44A and 44B, respectively as illustrated in FIGS. 5A and 5B. The brake axle 56 passes through the holes 55A and 55B in the sliding supports 44A and 44B respectively and through corresponding holes 49A and 49B in sliding plates 54A and 54B. The brake pawl 58 and the brake pawl spring 60 are disposed on the brake axle 56 between the sliding plates 54A and 54B. The brake pawl spring 60 functions to keep the brake pawl 58 operatively engaged to the ratchet wheel 46 so as to prevent unwinding of the spool 36 when pressure on the handle 38 is released. A spring perch 37 is disposed on an interior surface of the sliding plate 54B. The spring perch 37 secures a free end of the brake pawl spring 60 and ensures that the brake pawl 58 is biased to engage the ratchet wheel 46

Figure 1D:
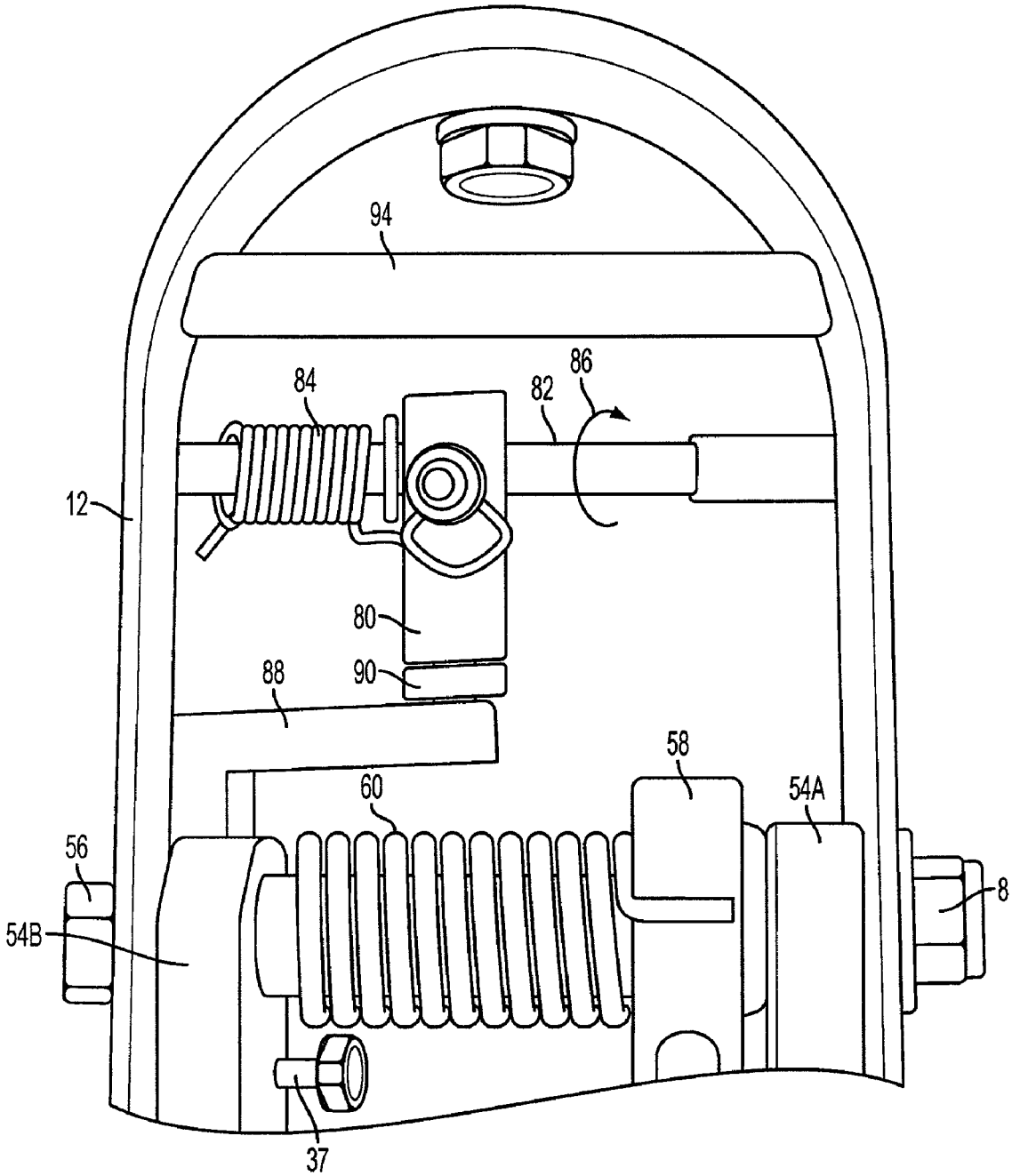
FIG. 1D is a top view of a limit switch assembly of the mechanical winch of FIG. 1A.

Referring now to FIG. 1D, a limit switch 80 is disposed on a limit switch axle 82. The limit switch 80 comprises an adjustable threaded member 90 connected thereto. A spring 84 biases the limit switch 80 to rotate in the direction of arrow 86. A stop 88 is rigidly connected to sliding support 44B. The stop 88 functions to prevent rotation of the limit switch 80. The use of the limit switch will be discussed in more detail below in connection with FIG. 6.

Referring now to FIG. 2, an exploded assembly of the mechanical winch 10 is shown. FIG. 2 shows a coupler 67 connected to the rounded end 13C of the external frame 12. In addition, a coupler 66 is connected to a free end 68 of the cable 52 which is wrapped around the spool 36. A cable guide 70 may be attached to the rounded end 13D. The cable 52 is stretched over the rounded end 13D and passes through the cable guide 70.

Still referring to FIG. 2, it is seen that sliding supports 44A and 44B may be designed to be received by a channel 39A and 39B in sliding plates 54A and 54B respectively. Once assembled, sliding support 44A and sliding plate 54A are placed on the interior side of parallel side 13A such that T-nuts 24A and 26A match up with notch 18A and slot 14A respectively. Similarly, sliding support 44B and sliding plate 54B are placed on the interior side of parallel side 13B such that T-nuts 24B and 26B match up with notch 18B and slot 14B respectively. An axial bore 35 passes through the spool 36 and receives spool axle 40 to secure the spool 36 to the exterior frame 12. FIG. 2 shows that the spool axle 40 passes through hole 53B, hole 47B, axial bore 35, hole 47A, hole 53A, and is secured by a nut 6. Similarly, brake axle 56 passes through hole 55B, hole 49B, brake pawl 58, hole 49A, hole 55A, and is secured by a nut 8.

Figure 3:
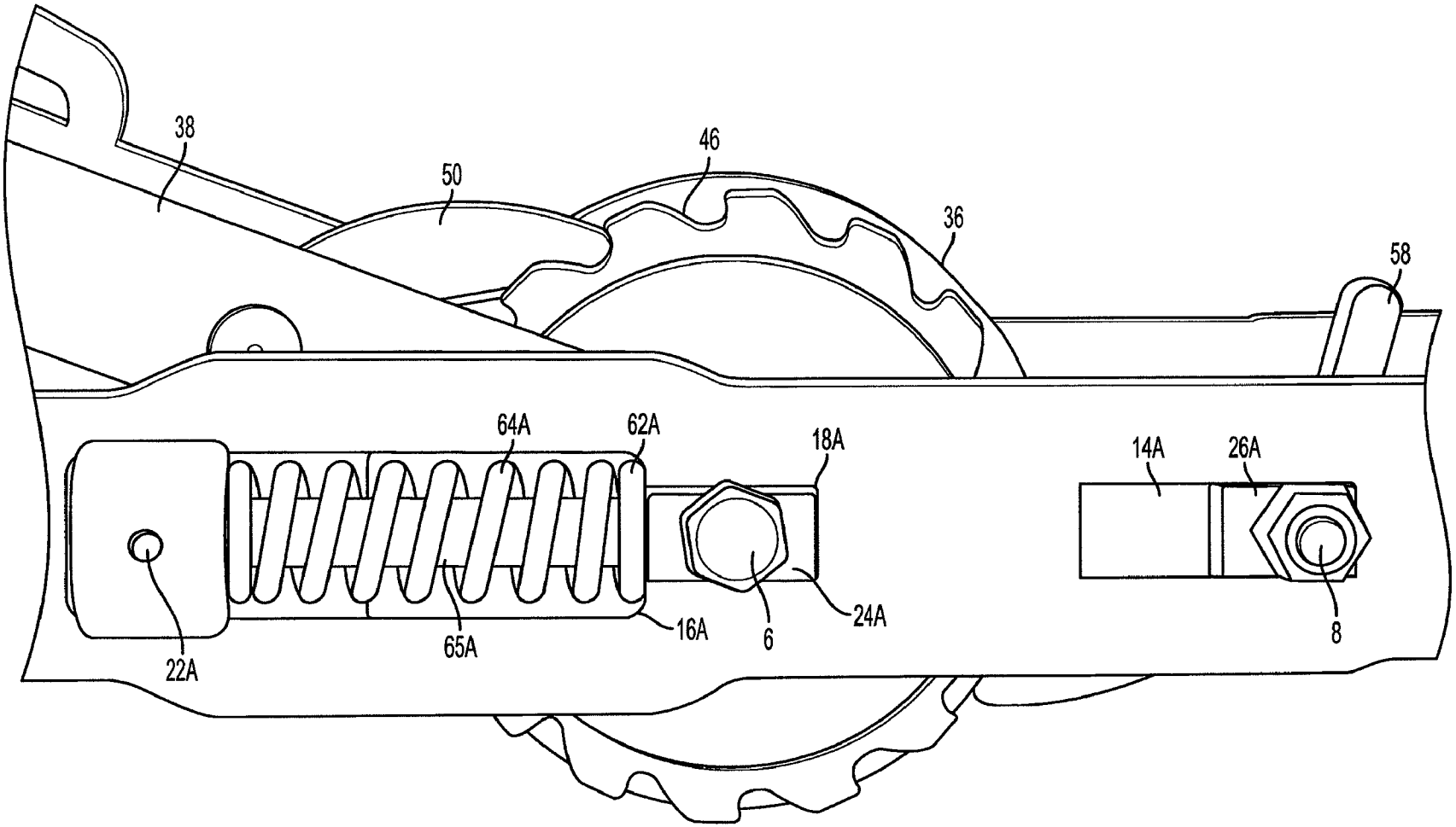
FIG. 3 is a side view of a portion of a frame of the mechanical winch of FIGS. 1A-1D.

Referring now to FIG. 3, spring 64A is shown located in slot 16A disposed between spring stops 22A and 62A. Spring 64A is disposed about a guide post 65A. Guide post 65A is rigidly connected at one end to spring stop 62A and is at least partially slidably disposed within spring stop 22A at the other end. T-nut 24A is shown disposed in notch 18A and is secured by nut 6. Also shown in FIG. 3, T-nut 26A is shown to be secured by nut 8 and slidably disposed in slot 14A.

Though not explicitly shown in FIG. 3, spring 64B, is located in slot 16B disposed between spring stops 22B and 62B. Spring 64B is disposed about a guide post 65B. Guide post 65B is rigidly connected at one end to spring stop 62B and is at least partially slidably disposed within spring stop 22B at another end. Also, T-nut 26B is slidably disposed in slot 14B.

Figure 4A:
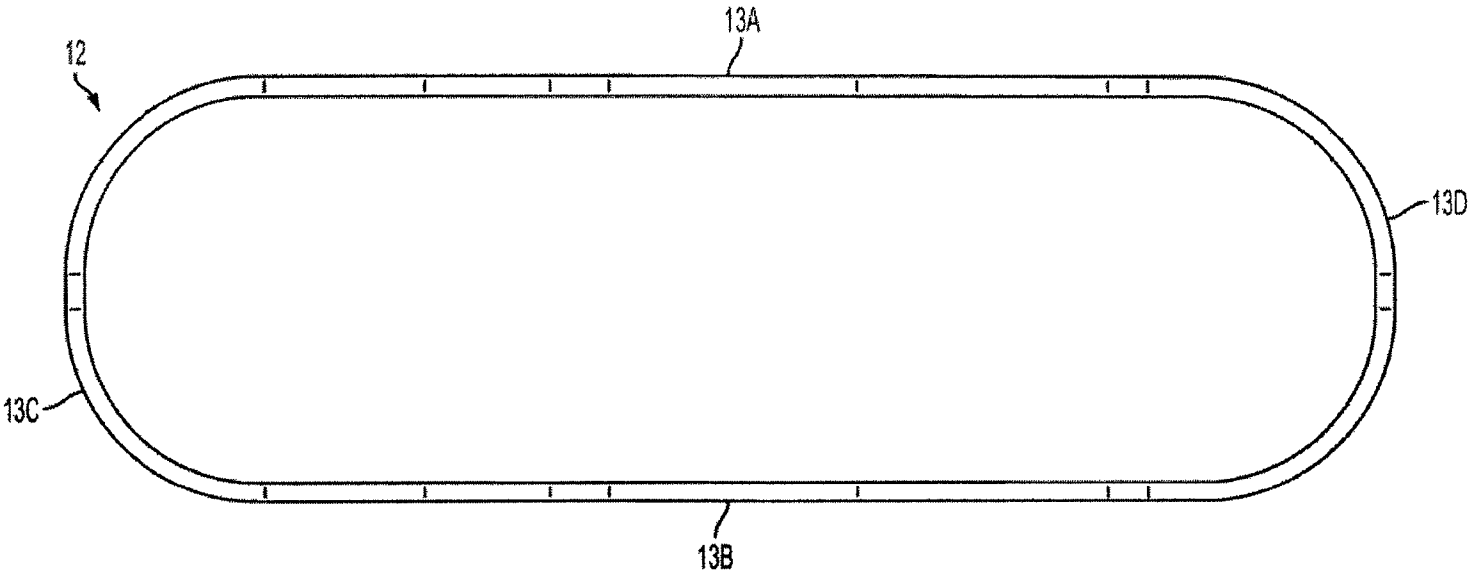
FIG. 4A is a top plan view of an exterior frame of the mechanical winch of FIGS. 1A-1D.
Figure 4B:
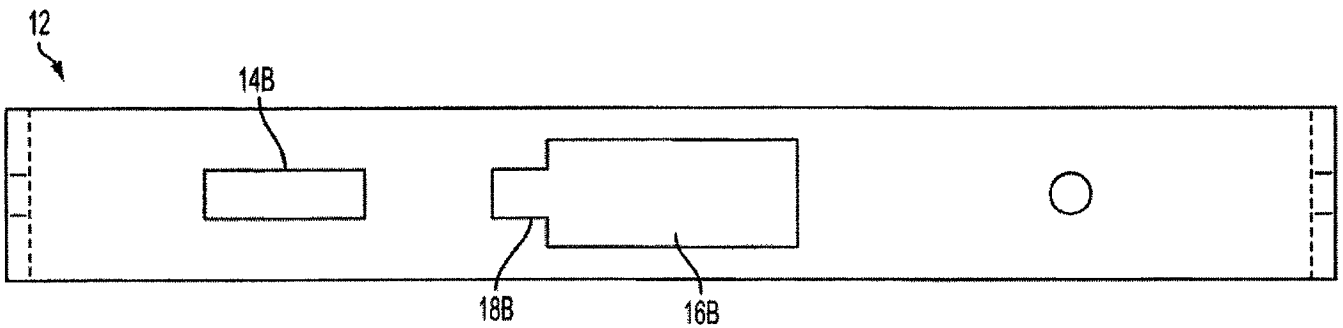
FIG. 4B is a side elevation view of the exterior frame of the mechanical winch of FIG. 4A.

Referring now to FIGS. 4A and 4B, the exterior frame 12 is shown in both a plan view and a side elevation view. As previously discussed with respect to FIGS. 1A and 1B, a pair of slots 14A and 14B, both having the form of a rectangular slot, are disposed opposite each other on the parallel sides 13A and 13B, respectively. Slot 14A, though not explicitly shown in FIGS. 4A and 4B, may be seen more clearly in FIG. 2 discussed above. Similarly, a pair of slots 16A and 16B, also having the form of a rectangular slot of slightly greater length and width than the slots 14A and 14B, are also disposed opposite each other on the parallel sides 13A and 13B respectively. A pair of notches 18A and 18B are cut into a side of slots 16A and 16B respectively on a side facing slots 14A and 14B respectively. Slot 16B, though not explicitly shown in FIGS. 4A and 4B, may be seen more clearly in FIG. 2 discussed above.

Referring now to FIGS. 5A and 5B, the sliding supports 44A and 44B are shown. Sliding supports 44A and 44B are rigid supports that ensure a constant distance is maintained between the spool axle 40 and the brake axle 56. This is necessary to maintain engagement of the brake pawl 58 when tension is applied to the cable 52. The sliding supports 44A and 44B are disposed on opposite sides of the spool 36 such that the spool axle 40 passes through a hole 53A and 53B in sliding supports 44A and 44B respectively. Similarly, brake axle 56 passes through a hole 55A and 55B of sliding supports 44A and 44B respectively.

Referring now specifically to FIG. 5A, sliding support 44A includes T-nuts 24A and 26A throughwich holes 53A and 55A respectively pass. T-nuts 24A and 26A are adapted for slidable engagement within notch 18A and slot 14A respectively. Referring now specifically to FIG. 5B, sliding support 44B includes T-nuts 24B and 26B throughwhich holes 53B and 55B respectively pass. T-nuts 24B and 26B are adapted for slidable engagement with notch 18B and slot 14B respectively. Sliding support 44B further includes a stop 88, which is discussed above in the discussion of FIG. 1D.

Figure 6:
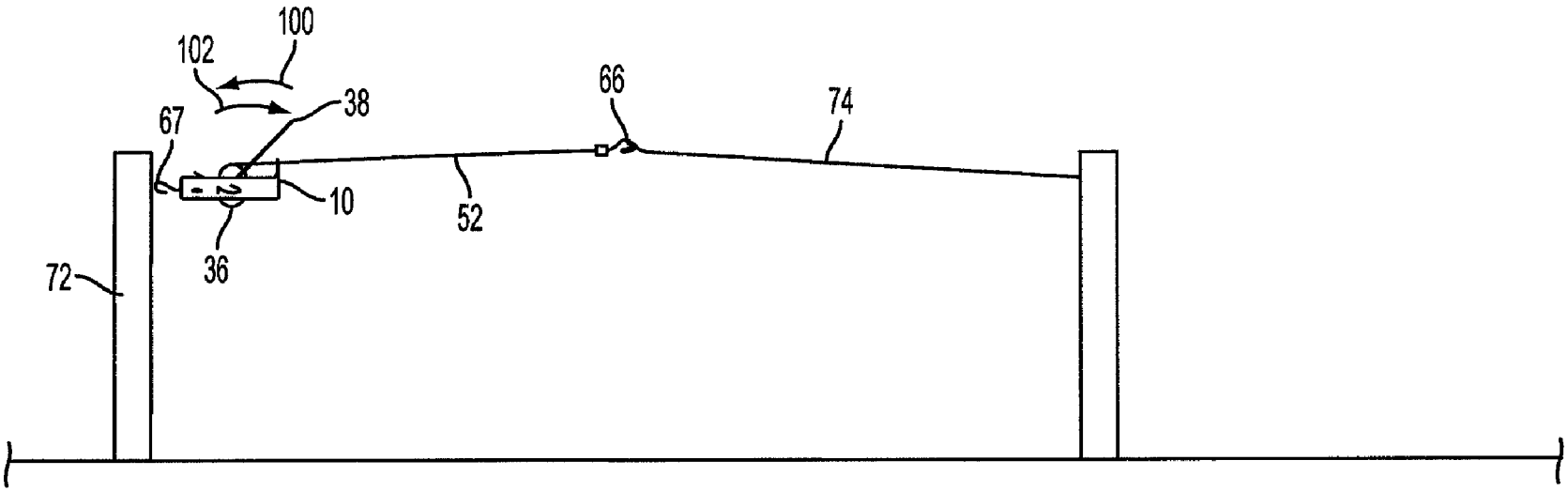
FIG. 6 is a diagrammatical illustration of the mechanical winch of FIGS. 1A-1D in operation.

Referring now to FIG. 6, during operation, the coupler 67 is first connected to a stable support, shown by way of example in FIG. 6 to be a fence post 72. The coupler 66 is attached to the length of cable, wire, or other tether to be tensioned. Again by way of example, the coupler 66 is shown attached to a length of wire 74 similar to that which would be used in fencing. When the handle 38 is actuated in the direction noted by arrow 100, the drive pawl 50 engages the ratchet wheel 46, and causes the spool 36 to rotate in the same direction as the handle 38. As the spool 36 rotates, the cable 52 is wound around the spool 36. When the handle 38 is actuated in a direction noted by arrow 102, the drive pawl 50 does not engage, and does not impart any motion to, the ratchet wheel 46. In this situation, the brake pawl 58 engages the ratchet wheel 46, and prevents the spool 36 from unwinding and releasing the tension on the cable 52. Thus, repeated arcuate movements of the handle 38 results in the cable 52 becoming increasingly wound around the spool 36 and incrementally greater tension being applied to the wire 74.

Referring collectively to FIGS. 1A-1D and FIG. 6, as the load applied to the wire 74 increases, the spool support assembly 34 tends to slide within the exterior frame 12 in a direction denoted by arrow 104 (shown specifically in FIGS. 1B and 1C). This motion tends to compress the springs 64A and 64B. As the spool support assembly 34 slides in the direction denoted by the arrow 104, the sliding supports 44A and 44B and sliding plates 54A and 54B serve to maintain a constant distance between the spool axle 40 and the brake axle 56. Such an arrangement ensures that the brake pawl 58 remains engaged to the ratchet wheel 46 thus preventing the inadvertent release of tension on the wire 74. The linear deflection of the springs 64A and 64B can be measured using a scale 76 (shown specifically in FIG. 1B), which may be attached to an upper surface of the exterior frame 12. The scale 76, by way of example, is shown in FIG. 1B to be comprised of a reference marker 76*a* applied to the upper surface of the sliding plate 54A and a series of indicia 76*b* applied to the upper surface of the exterior frame 12. The position of the reference marker relative to the indicia indicates the degree of linear deflection of the springs 64A and 64B. The magnitude of force applied to the wire 74 can then be determined through the application of Hooke's Law ($F=-kx$), where F is the force applied to the wire 74, x is the linear deflection of the spring away from its equilibrium position, and k is a physical property of the spring known as the "force constant" or "spring constant." This property is commonly referred to as the "stiffness" of the spring. In one embodiment the scale 76 may simply measure deflection of the springs 64A and 64B, leaving the force to be computed by the operator using a known spring constant. However, in the preferred embodiment, the scale 76 is calibrated to a particular spring to measure force as a function of deflection.

Referring again to FIG. 1D, it is further contemplated that the magnitude of the force applied to the wire 74 may be determined through the observation of a limit switch 80. As previously discussed above with respect to FIG. 1D, the limit switch 80 is disposed on a limit switch axle 82. The limit switch 80 comprises an adjustable threaded member 90 connected thereto. A spring 84 biases the limit switch 80 to rotate in the direction of arrow 86. A stop 88 is rigidly connected to sliding support 44B (shown in FIG. 2). The stop 88 functions to prevent rotation of the limit switch 80.

Prior to use, the limit switch 80 must be adjusted for the amount of tension to be applied to the wire 74. This is accomplished by adjusting the adjustable threaded member 90 to have an exposed length appropriate for the amount of force to be applied to the wire 74. By way of example, if a large amount of tension is to be applied to the wire 74, then the adjustable threaded member 90 would be threaded out of the limit switch 80, thereby increasing the exposed length of the adjustable threaded member 90. This results in more tension being applied to the wire 74 before the limit switch 80 is released. On the other hand, if a smaller amount of tension is to be applied to the wire 74, then the adjustable threaded member 90 would be threaded into the limit switch 80, thereby reducing the exposed length of the adjustable threaded member 90. This results in less tension being applied to the wire 74 before the limit switch 80 is released.

Next, the limit switch 80 must be set, this is accomplished by rotating the limit switch 80 about the limit switch axle 82 in a direction opposite that defined by the arrow 86. Such rotation causes the spring 84 to bias the limit switch 80 to rotate in the direction denoted by the arrow 86. During setting, the limit switch 80 may slide laterally across the limit switch axle 82 so as to allow the adjustable threaded member 90 to be passed underneath the stop 88. The stop 88 restrains the tendency of the limit switch 80 to rotate in the direction denoted by the arrow 86.

During operation, a load is applied to the wire 74 through successive actuation of the handle 38. As previously discussed, as the load applied to the wire 74 increases, the spool support assembly 34 tends to slide, within the exterior frame 12, in a direction denoted by arrow 104 as shown in FIG. 1C. This motion tends to compress the springs 64A and 64B. As the spool support assembly slides in the direction denoted by the arrow 104, the stop 88 also moves in the direction of arrow 104. Eventually, sufficient force is applied to the wire 74 to move the spool support assembly 34 and the stop 88 a sufficient distance to allow the stop 88 to become disengaged from the adjustable threaded member 90 of the limit switch 80. The spring 84 then induces the limit switch 80 to rotate about the limit switch axle 82 in the direction denoted by the arrow 86. In some embodiments, such motion may be accompanied by an audible noise as a portion of the limit switch 80 strikes a frame support member 94. This arrangement allows a user to easily and visibly and audibly ascertain when a pre-determined load has been applied to the wire 74.

In the event that the operator desires to relieve the load applied to the wire 74, the operator simply fully actuates the handle 38 in the direction depicted by the arrow 100. If a large amount of load has been applied to the wire 74, it may be necessary to actuate the drive pawl 50 so as to disengage the drive pawl 50 from the ratchet wheel 46. Such disengagement will allow the handle to rotate independently of the spool without applying any additional load to the wire 74. When the handle has been fully actuated in the direction depicted by the arrow 100, the drive pawl contacts the brake pawl 58. The interaction between the drive pawl 50 and the brake pawl 58 causes the brake pawl 58 to also become disengaged from the ratchet wheel 46. The disengagement of both the drive pawl 50 and the brake pawl 58 allows the spool 36 to rotate freely and relieves the load applied to the wire 74.

It is further contemplated that the springs 64A and 64B may be interchangeable to allow use of the mechanical winch 10 with springs of varying stiffness. This functionality allows the mechanical winch 10 to measure a wider range of force, and adapts the device for use in a wide array of applications. Interchanging springs 64A and 64B may be accomplished through any appropriate means, but as currently contemplated, may be accomplished by removing the T-nuts 24A and 24B and the spring stops 62A and 62B. If the scale 76 is calibrated to measure force, then the scale 76 may also be interchangeable and constitute more than the indicia shown in FIG. 1B.

Although various embodiments of the method and apparatus of the present invention have been illustrated in the accompanying Drawings and described in the foregoing Detailed Description, it will be understood that the invention is not limited to the embodiments disclosed, but is capable of numerous rearrangements, modifications, and substitutions without departing from the spirit and scope of the invention as set forth in the foregoing specification and following claims.

What is claimed is:

1. A mechanical winch of the type operable for stretching wire and/or cables, the mechanical winch comprising:

a spool axle slidably disposed within a frame and coupled thereto by a plurality of springs, the spool axle having a spool disposed therearound;

a length of cable or wire operably coupled to the spool;

a brake axle slidably disposed within the frame and located a fixed distance from the spool axle; and wherein actuation of the spool applies increasing tension to the length of cable or wire and causes compression of the plurality of springs.

2. The mechanical winch of claim 1, wherein the brake axle comprises a brake pawl operable to removably engage at least a portion of the spool and permit rotation of the spool in one direction only.

3. The mechanical winch of claim 1, wherein the spool axle and the brake axle are each connected to a pair of sliding supports, the pair of sliding supports slidably coupled to an interior of the frame and operable to maintain a constant distance between the spool axle and the brake axle.

4. The mechanical winch of claim 3, further comprising a spring-actuated limit switch coupled to the frame, the spring-actuated limit switch operative to engage a stop extending from at least one sliding support of the pair of sliding supports and to be released upon an application of a pre-determined threshold tension.

5. The mechanical winch of claim 4, wherein the spring-actuated limit switch comprises a threaded member at least partially disposed therein.

6. The mechanical winch of claim 5, wherein the pre-determined threshold tension may be varied responsive to adjustment of an exposed length of the threaded member.

7. The mechanical winch of claim 1, wherein:

the frame comprises at least one pair of generally parallel segments, each of the generally parallel segments having a plurality of slots; and the plurality of springs are disposed within the plurality of slots.

8. The mechanical winch of claim 1, further comprising a scale disposed on a top surface of the frame and a top surface of at least one sliding support of the pair of sliding supports, the scale operable to indicate an amount of tension applied to the length of cable or wire.

9. The mechanical winch of claim 1, wherein the plurality of springs are selectively interchangeable.

10. A method of manufacturing a calibrated mechanical winch, the method comprising:

forming a frame having first and second oppositely-disposed pairs of slots formed therein;

providing a spool axle spanning opposite sides of the frame and slidably disposed within the first oppositely-disposed pair of slots;

providing at least one spring connected at a first end to the frame and connected at a second end to the spool axle;

providing a spool assembly having a length of cable or wire connected thereto, the spool assembly located about the spool axle;

providing a brake axle spanning opposite sides of the frame and slidably disposed within the second oppositely-disposed pair of slots;

locating the brake axle a fixed distance from the spool axle; and wherein actuation of the spool assembly applies increasing tension to the length of cable or wire and causes compression of the at least one spring.

11. The method of claim 10, wherein forming the frame comprises forming the frame out of a single piece of material.

12. The method of claim 10, wherein forming the frame comprises joining at least two pieces of material.

13. The method of claim 10, wherein providing the spool axle comprises connecting the spool to a pair of sliding supports slidably disposed within an interior of the frame.

14. The method of claim 13, wherein locating the brake axle a fixed distance from the spool comprises connecting the brake axle to the pair of sliding supports.

15. The method of claim 13, further comprising locating an adjustable, spring- actuated limit switch within the frame, the adjustable spring-actuated limit switch operable to engage a stop attached to at least one sliding support of the pair of sliding supports.

16. A method of tensioning a cable or wire, the method comprising:

providing a mechanical winch having first and second couplers;

connecting the first coupler to a fixed support;

connecting the second coupler to a length of cable or wire to be tensioned;

applying tension to the length of cable or wire via actuation of the mechanical winch;

compressing a plurality of springs located in the mechanical winch responsive to the tension applied to the length of cable or wire;

measuring tension applied to the length of cable or wire as a function of compression of the plurality of springs; and measuring a pre-determined threshold tension via observation of a spring-actuated limit switch.

17. The method of claim 16, wherein applying tension to the length of cable or wire comprises repeatedly actuating a handle.

18. The method of claim 17, wherein applying tension to the length of cable or wire comprises applying incrementally increasing tension with each successive actuation of the handle.

19. The method of claim 16, wherein measuring tension applied to the length of cable or wire comprises reading a scale disposed on the mechanical winch.

20. The method of claim 16, further comprising:

varying the pre-determined threshold tension via adjusting an exposed length of a threaded member operably coupled to the spring-actuated limit switch.

21. The method of claim 16, wherein actuating a brake pawl releases the tension applied to the cable or wire.

* * * * *